US008770205B1

(12) United States Patent
Hopwood

(10) Patent No.: US 8,770,205 B1
(45) Date of Patent: Jul. 8, 2014

(54) CIGAR HOLDER

(71) Applicant: Richard E. Hopwood, Fort Worth, TX (US)

(72) Inventor: Richard E. Hopwood, Fort Worth, TX (US)

( * ) Notice: Subject to any disclaimer, the term of this patent is extended or adjusted under 35 U.S.C. 154(b) by 0 days.

(21) Appl. No.: 13/685,770

(22) Filed: Nov. 27, 2012

(51) Int. Cl.
*A24F 13/22* (2006.01)

(52) U.S. Cl.
USPC ..... 131/257; 248/153; D27/138; 131/260

(58) Field of Classification Search
USPC ..... 131/257, 258; 248/153, 315; D27/138
See application file for complete search history.

(56) References Cited

U.S. PATENT DOCUMENTS

| | | | | | |
|---|---|---|---|---|---|
| 1,834,569 | A | * | 12/1931 | Babor | 131/258 |
| 2,093,760 | A | | 9/1937 | Kiernan | |
| 2,210,291 | A | | 8/1940 | Herr | |
| 2,213,046 | A | | 8/1940 | Mather | |
| 2,280,543 | A | | 4/1942 | Saunders | |
| D139,538 | S | | 11/1944 | Comstock | |
| 3,292,640 | A | | 12/1966 | Royal | |
| 3,426,762 | A | | 2/1969 | Vitale | |
| D332,821 | S | * | 1/1993 | Padilla | D22/147 |
| 5,511,754 | A | * | 4/1996 | Johannsen | 248/311.2 |
| 5,570,863 | A | * | 11/1996 | Cooper | 248/146 |
| 7,175,147 | B1 | * | 2/2007 | Marks et al. | 248/303 |
| D555,461 | S | * | 11/2007 | Tincher | D8/370 |

* cited by examiner

*Primary Examiner* — Richard Crispino
*Assistant Examiner* — Dionne Walls Mayes
(74) *Attorney, Agent, or Firm* — James E. Walton; Damon R. Hickman

(57) ABSTRACT

A cigar holder for securing a wide variety of differently shaped cigars to a variety of different mounting locations.

5 Claims, 7 Drawing Sheets

CIGAR HOLDER

BACKGROUND

1. Field of the Invention

The present invention relates in general to the field of cigar holders.

2. Description of Related Art

Cigar holders generally serve several purposes. First, cigar holders must be capable of holding a cigar. Second, the surface area of the cigar in contact with the holder is minimized. Third, in general there is a repository for the ash produced from the cigar as it is burned.

Referring to FIG. 1 in the drawings, an example of a cigar holder 101. Cigar holder 101 comprises a notch 111 that is sized for a cigar 121. Cigar holder 101 has a recessed area 131 capable of holding the ash produced as cigar 121 is consumed by combustion.

There are no typical size for cigars. The general range of diameters of cigars starts around 28/64's of an inch and ends around 54/64's of an inch. The general range of lengths of cigars starts at around 4½ inches and around 9¼ inches. Additionally, there is no common shape of cigars. Cigars can be straight sided or irregularly shaped. Some of the irregular shaped cigars can be shaped like torpedoes, pyramids, perfectos, and presidentes. Cigars have three general regions: an opened end or foot 141 of the cigar, a closed end called the head 151, and a body 161 located generally between the foot 141 and the head 151. The head 151 is sealed during manufacture of the cigar and normally opened before consumption of the cigar. The foot 141 is the part of the cigar that is ignited.

Previous attempts to secure cigars such as the cigar holder 101 have been designed to accommodate the wide variety of cigars shapes, lengths, and diameters. To prevent sweating of the cigar during combustion the cigar normally rests in the notch such that only the body 161 and the notch 111 are in contact. Sweating occurs where the tars and other byproducts of incomplete combustion are transferred back onto the cigar from contact with the holder. For example, the notch 111 in cigar holder 101 must be sized so that the largest diameter cigars will be contained. Sizing the notch 111 so large creates a problem when smaller diameter cigars are used with cigar holder 101. Smaller diameter cigars are left with extra room in the notch 111, resulting in a less secure hold. Additionally, the length of the cigar holder 101 must be great in order to accommodate the wide variance in cigar lengths. Cigar holder 101 is typically fabricated from a noncombustible material like glass. These design constraints results in a cigar holder 101 that is destined for a flat surface like a desk or table because of the size and weight of the cigar holder 101.

Considering that cigar smoking is a recreational activity, some cigar smokers prefer to combine cigar smoking with other recreational activities. For example, some cigar smokers prefer to smoke cigars while playing golf. Since golf requires the use of both hands to swing, cigar smoking while playing a round requires the cigar to be placed somewhere while swinging. It is undesirable to place the cigar on the ground while swinging. Damage to the cigar may occur while the cigar is on the ground. While it is possible to swing a golf club while holding the cigar in the golfer's mouth, it is not very practical to do so. Additionally, the cigar holder 101 would not be suitable on a golf cart. Because golf carts are typically rented during a golfing round a temporary and secure cigar holder is necessary.

Thus, there exists significant room for improvement in the art for overcoming these and other shortcomings of conventional cigar holders for securing cigars.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
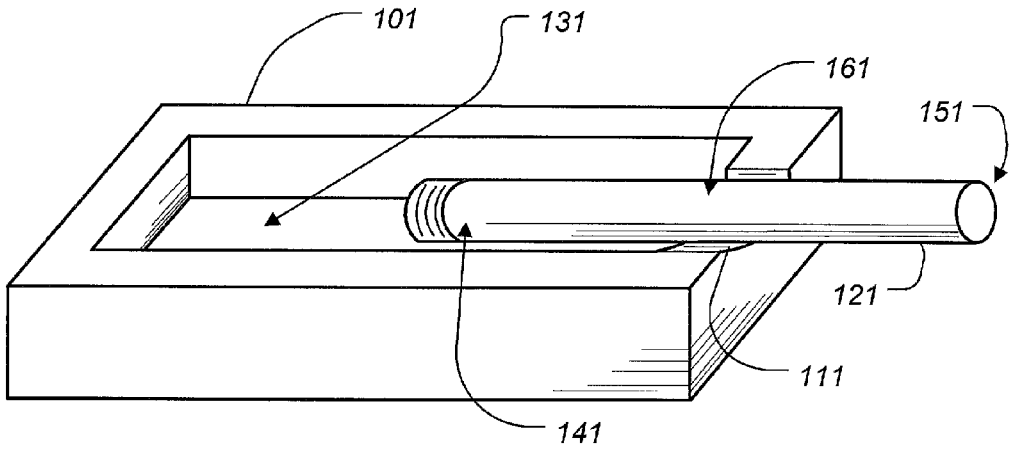
FIG. 1 (Prior Art)
FIG. 1 is a perspective view of a conventional cigar holder.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the cigar holder are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
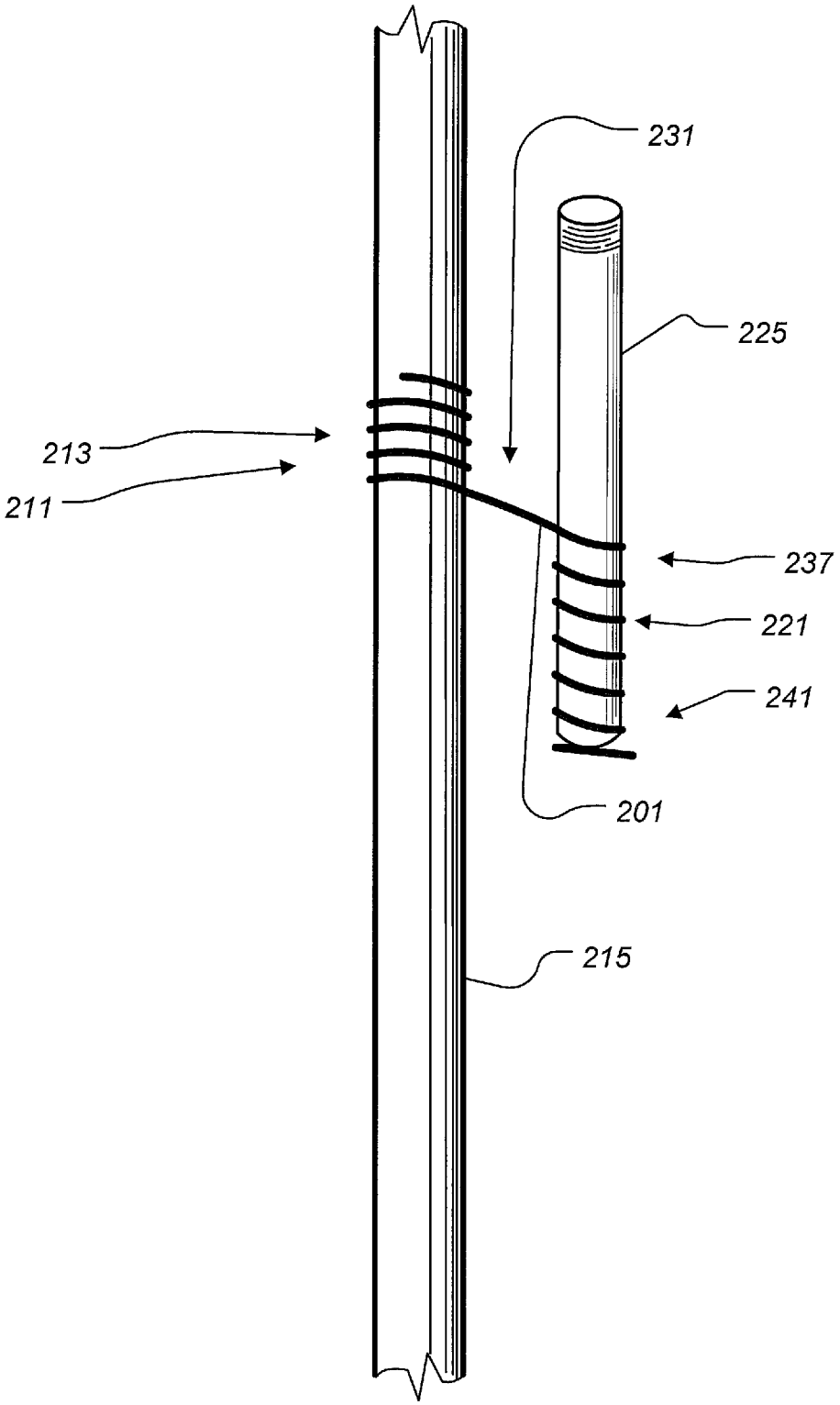
FIG. 2 is a perspective view of the preferred embodiment of an improved cigar holder according to the present application.
Figure 3:
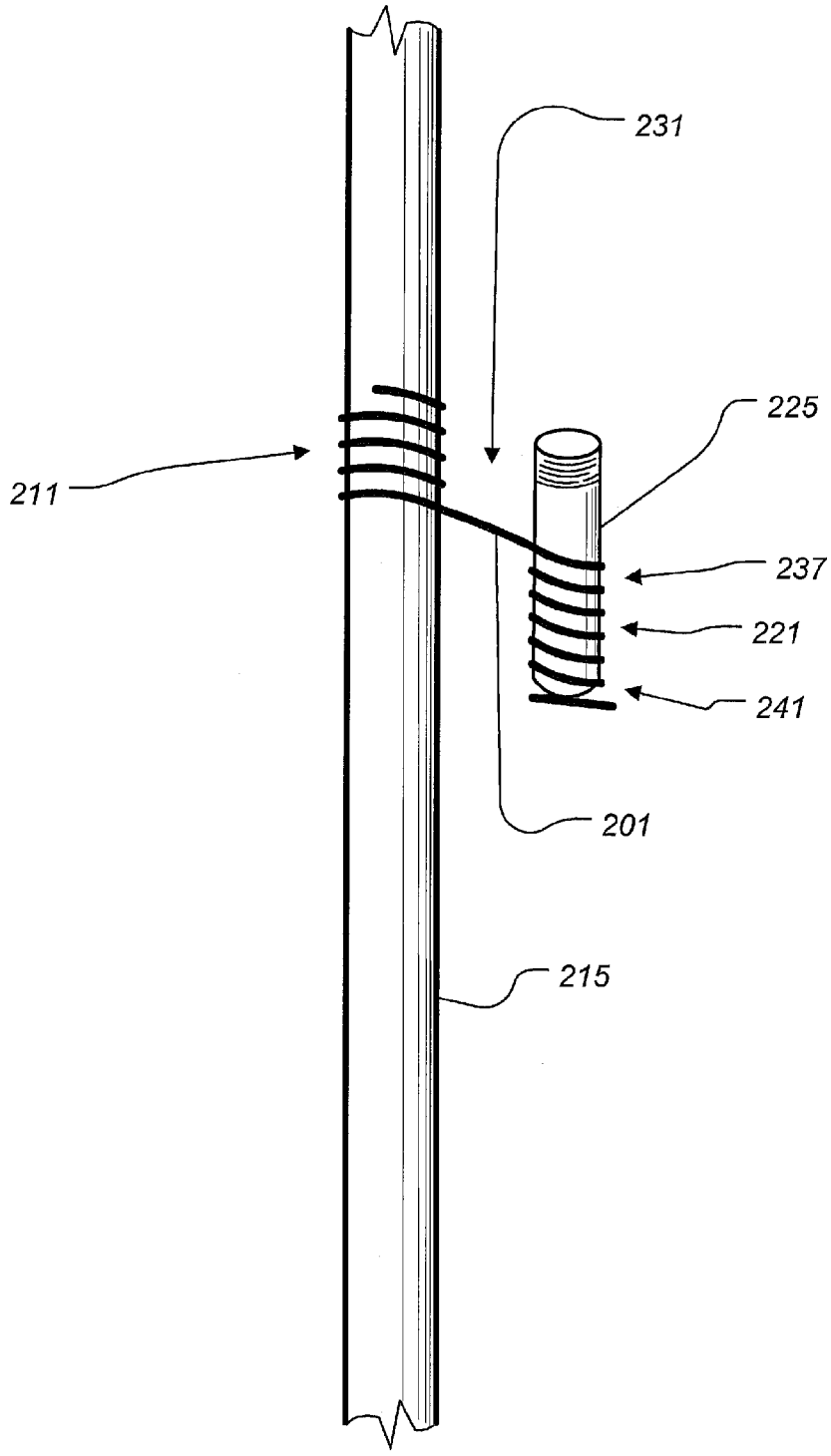
FIG. 3 is a perspective view of an improved cigar holder according to the present application.

Referring to FIG. 2 and FIG. 3 in the drawings, preferred embodiments of an improved cigar holder according to the present application are illustrated. Due to the fact that golf carts typically do not have a cigar holder built into them and the temporary nature of golf cart usage, an improved cigar holder 201 is needed. Cigar holder 201 is comprised of a semi-flexible strand of material. The material should be rigid enough to hold a shape yet flexible and resilient so that the user can reposition the cigar holder 201 without the material fatiguing. Preferably the cigar holder 201 is a elongated flexible rod, made from a strand of 13 gauge metallic wire and then covered in a plastic material like vinyl. The diameter of the flexible rod is based upon the flexibility inherent in the materials so that the cigar holder 201 is rigid enough to support what it holds while being supple enough to be adjusted by the user to hold onto whatever support structure the user wants to couple the cigar holder 201 to. It should be apparent that cigar holder 201 could be made entirely of other materials such as metallic wire, plastic, leather or some combination of them. Preferably the cigar holder 201 is manufactured from materials not readily combustible because of the proximity of the cigar holder 201 to a lit cigar. The length of straightened cigar holder 201 is based upon the size and weight of the item to be secured. For example, if something was larger and heavier then additional spirals are necessary for the cigar holder 201 to secure and support the item.

Cigar holder 201 has a first end, a second end, and a middle connecting the first end to the second end and is comprised of three general regions. First, there is the mounting region 211 where the cigar holder 201 is secured to a mounting fixture 215. Second, there is the holding region 221 where the cigar holder 201 actually holds the cigar 225. Finally, there is the interconnect region 231 that connects mounting region 211 to the holding region 221.

Mounting region 211 is comprised of a series of spirals 213 of the cigar holder 201 to form a helical shape. The spirals 213 allow the mounting region 211 to wrap around a mounting fixture 215. The user adjust the diameter of the spirals 213 dependent upon the diameter of the mounting fixture 215. Additionally the spirals can be wrapped around various structures. Preferably the spirals of the mounting region 211 are wrapped around a secure structure capable of holding the cigar holder with a lit cigar in a vertical position. Additionally, the preferred mounting location would protect adjacent people from inadvertent contact with the lit cigar. While the present application shows the cigar holder 201 secured to a golf cart, it should be apparent that cigar holder 201 is suitable for use wherever a cigar needs to be secured without concern for retaining ash.

Holding region 221 is comprised of a series of spirals of the cigar holder 201 to form a helical shape. Considering that cigar 225 will have a variety of diameters, lengths, and shapes the cigar holder 201 must be adjustable for the user to be able to securely hold the cigar 225 no matter the variation in shape of the cigar. Additionally, considering the cigar 222 will change proportions during combustion of the cigar 225 the cigar holder 201 must adjust to changes in the cigar's length. Adjustment of the cigar holder 201 can be performed by adjusting the distance between the spirals that contain the cigar 225. For example, if the cigar 225 is of a long length the spirals could be spaced apart by the user holding a first end of the spiral 237 and pulling the second end of the spiral 241 away. Alternatively, if the cigar is short the spirals could be spaced together by the user holding a first end of the spiral 237 and pushing the second end of the spiral 241 towards the first end of the spiral 237 see FIG. 3. Depending if the diameter of the cigar 225, the user can adjust the diameter of the spirals of the cigar holder 201 in the holder region 221. Another advantage of cigar holder 201 is the ability of cigar holder 201 to adapt to secure other things in place of the cigar 225. For example cigar holder 201 could be configured by the user to secure a phone, a writing utensil, a screwdriver, flashlight, or a water bottle. Cigar holder 201 is suitable for securing items a user would normally carry in their pockets but simply not have room for them. Configuring the cigar holder 201 by the user includes shaping the holding region 221 to conform to the shape of the device to be held. Considering that the mounting region 211 could be configured by the user to conform to the shape of a wide variety of mounting fixtures the ability of the cigar holder 201 to secure objects for the user is a variety of locations and environments is great.

The interconnect region 231 serves to connect the mounting region 211 to the holding region 221. The interconnect region 231 serves several purposes. First, the interconnect region 231 must be stiff enough to support the weight of not only the cigar holder 201 while suspended off of the mounting fixture 215 but also support the weight of the cigar 225. Second, the interconnect region must be flexible enough to allow the user to configure the cigar holder 201 as necessary. Considering that the holding region 221 needs to be fairly vertical, to counteract gravity, the interconnect region 231 must allow the user to adjust the cigar holder 201 such that the mounting region 211 is secure and the holding region 221 will not let the cigar 225 slip out. Thirdly, the interconnect region 231 must be giving and not so rigid that the interconnect region 231 fractures as a result of the oscillation of the holding region 221 being suspended off of the mounting fixture 215. Ideally, the interconnect region 231 would dampen some of the oscillations of the holding region 221 that occur as the golf cart is driven. In an alternate embodiment the interconnect region is a integrated cup in order to retain something in addition to the cigar 225 or in place of the cigar 225. In those instances where the cigar 225 is not being secured by the cigar holder the holding region 221 is wrapped around the mounting fixture 215 to assist in supporting the integrated cup.

Figure 4:
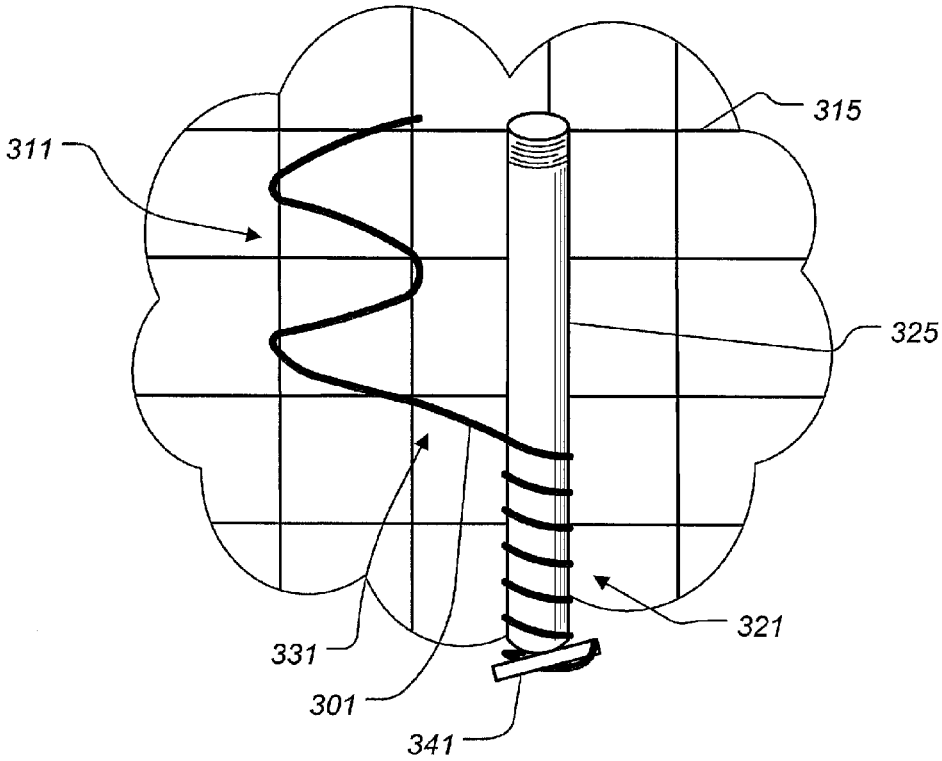
FIG. 4 is a perspective view of an improved cigar holder according to the present application.

Referring now also to FIG. 4 in the drawings, a preferred embodiment of an improved cigar holder according to the present application is illustrated. Cigar holder 301 is comprised of three general regions. First, there is the mounting region 311 where the cigar holder 301 is secured to a netted material 315. Second, there is the holding region 321 where the cigar holder 301 actually holds the cigar 325. Finally, there is the interconnect region 331 that connects mounting region 311 to the holding region 321. Bottom 341 is coupled adjacent to the end of the cigar holder 301. Bottom 341 is designed to assist retaining a cigar 325 of such a small diameter that would likely fall through the gaps in the cigar holder 301. Bottom 341 in the preferred embodiment is a solid tab however in alternate embodiments the bottom 341 is slotted or perforated to reduce the accumulation of debris. Bottom 341 in the preferred embodiment is made of plastic, however the bottom 341 could be made of plastic, resin, wood or any similar materials.

It should be apparent that mounting region 311 is capable of being adjusted by the user to secure the cigar holder to a variety of fixtures, poles, brackets, and nets. The adjustment of mounting region 311 occurs by the user shaping the mounting region 311 to grasp the fixture the user wants to mount the cigar holder 301 to.

Figure 5:
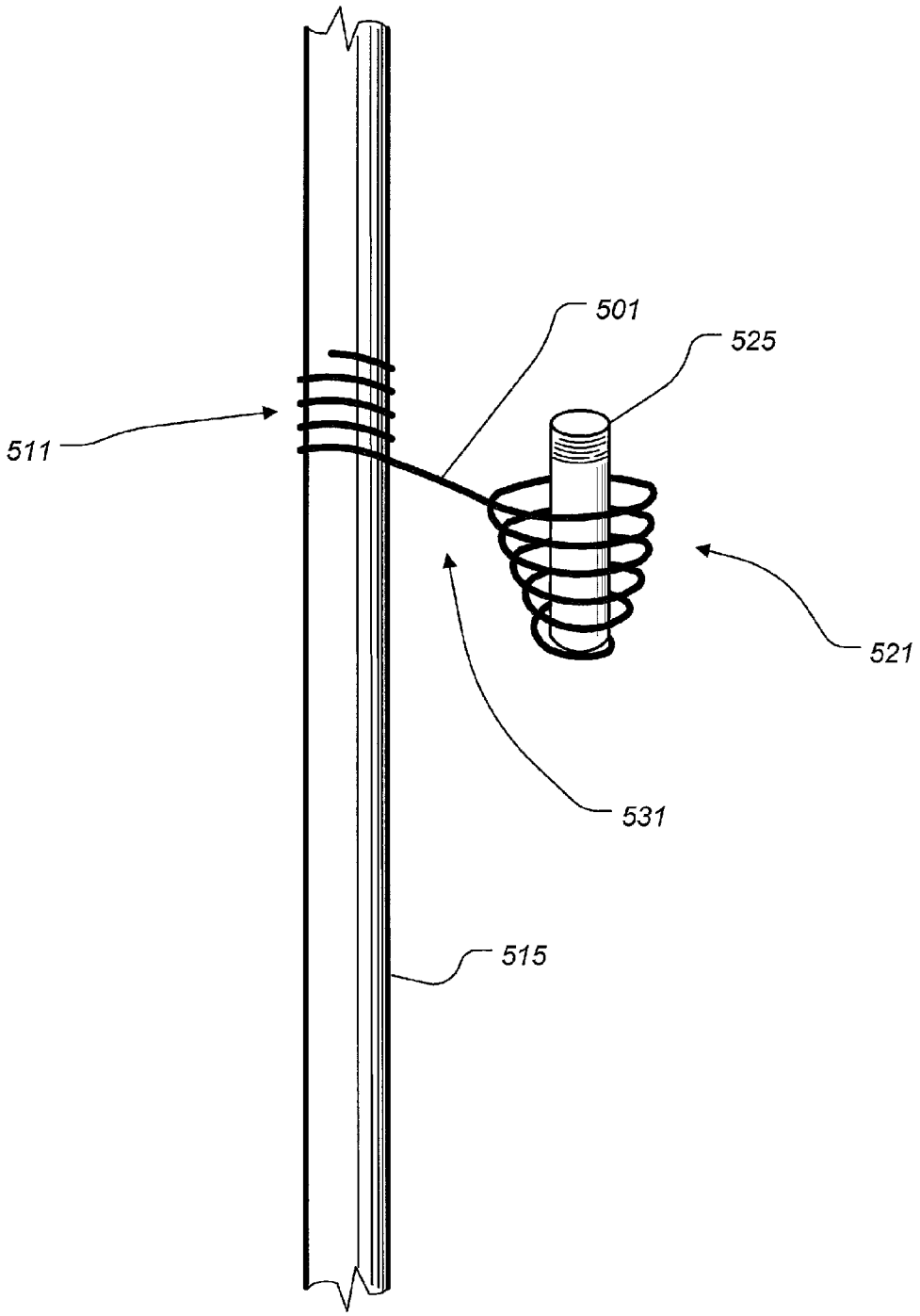
FIG. 5 is a perspective view of an improved cigar holder according to the present application.

Referring now also to FIG. 5 in the drawings, an alternative embodiment of an improved cigar holder according to the present application is illustrated. Cigar holder 501 is comprised of three general regions. First, there is the mounting region 511 where the cigar holder 501 is secured to a mounting fixture 515. Second, there is the holding region 521 where the cigar holder 501 actually holds the cigar 525. Finally, there is the interconnect region 531 that connects mounting region 511 to the holding region 521. In this embodiment the shape of the holding region 521 is a spiral that narrows towards one end. The narrowing of the holding region 521 allows cigars of different shapes to be held.

Figure 6:
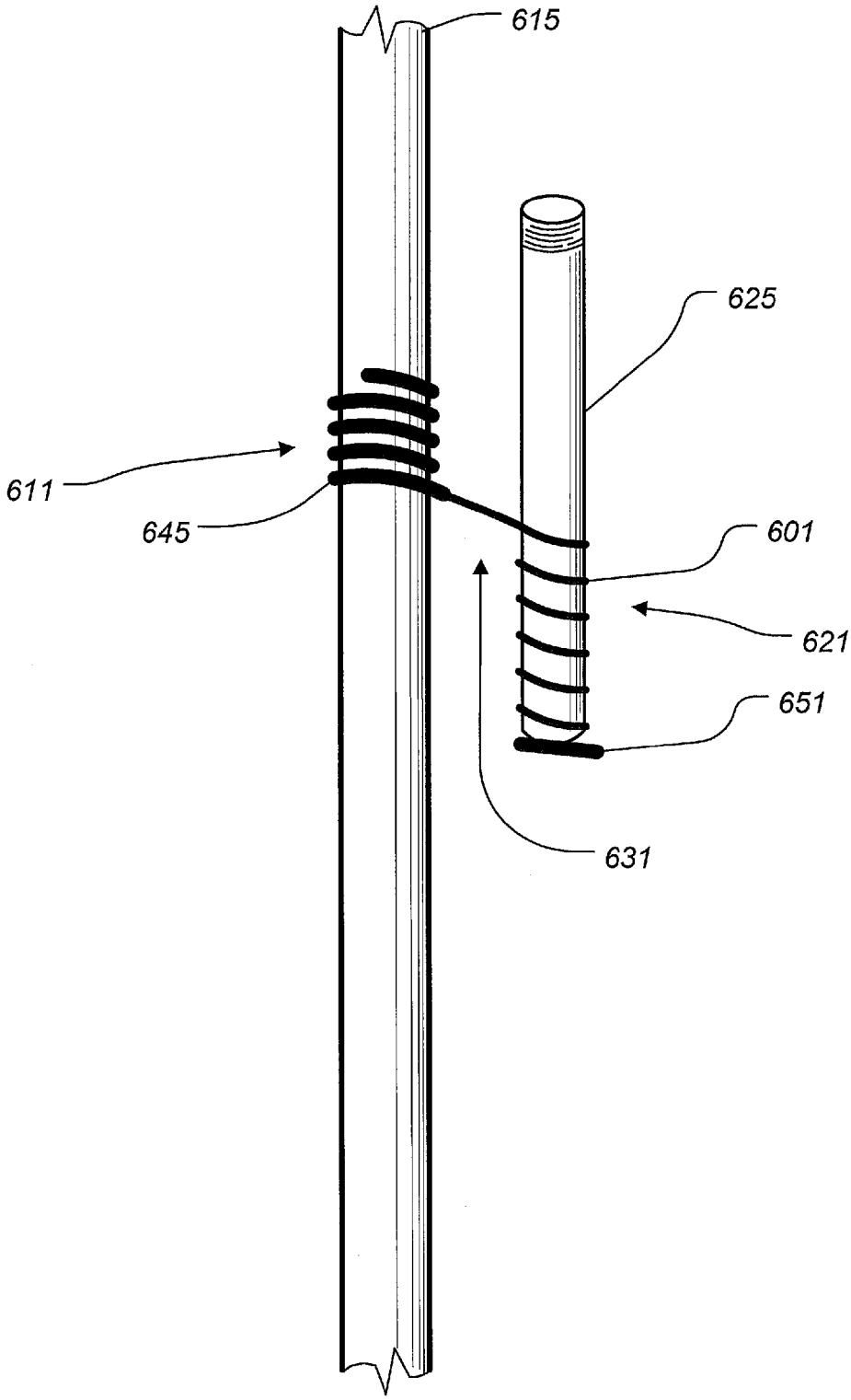
FIG. 6 is a perspective view of an alternate embodiment of an improved cigar holder according to the present application.

Referring now also to FIG. 6 in the drawings, an alternate embodiment of an improved cigar holder according to the present application is illustrated. Cigar holder 601 is comprised of three general regions. First, there is the mounting region 611 where the cigar holder 601 is secured to a mounting fixture 615. Second, there is the holding region 621 where the cigar holder 601 actually holds the cigar 625. Finally, there is the interconnect region 631 that connects mounting region 611 to the holding region 621. In this embodiment the mounting region 611 has an additional layer 645 or coating applied to increase friction and reduce slipping. Layer 645 provides additional griping to the cigar holder 601. Layer 645 is preferably a tactile rubber compound; however layer 645 could be made of vinyl, silicone, PVC, leather or other materials that increase the friction between the cigar holder 601 and the mounting fixture 615. Layer 645 could be of various thicknesses dependent upon its location along the cigar holder 601. Alternatively to the layer 645, a treatment could be applied to cigar holder 601 such as texturing, roughing, crimping to increase the coefficient of friction between the cigar holder 601 and what the cigar holder 601 is retaining like the cigar 625 or mounting fixture 615. It should be apparent that layer 645 as shown in this embodiment applied to the mounting region 611 could be applied to the holding region 621, the interconnect region 631, or a combination of the regions. Additionally, cigar holder 601 includes a first cap 651 disposed adjacent to the end of the flexible rod. First cap 651 is preferably made of a layer of plastic however it may be fabricated out of any material suitable for sealing and protecting the end of the cigar holder 601. First cap 651 is capable of sealing either or both ends of the cigar holder 601 with the addition of a second cap.

Figure 7:
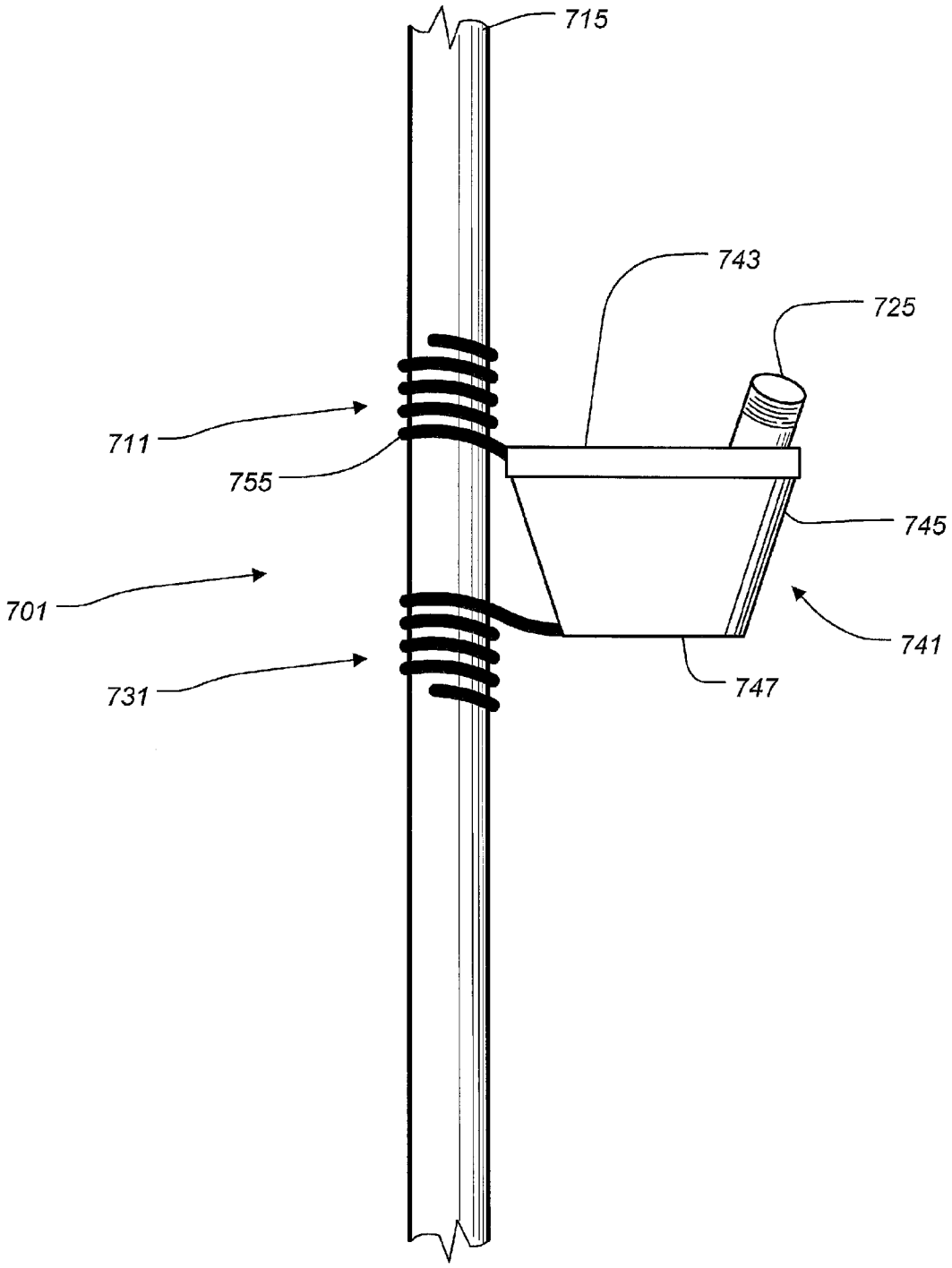
FIG. 7 is a perspective view of an alternate embodiment of an improved cigar holder according to the present application.

Referring now also to FIG. 7 in the drawings, an alternate embodiment of an improved cigar holder according to the present application is illustrated. Cigar holder 701 is comprised of three general regions. First, there is the first mounting region 711 where the cigar holder 701 is secured to a mounting fixture 715. Second, there is the holding region 721 where the cigar holder 701 actually holds the cigar 725 in a vessel shaped holder 741. Finally, there is the second mounting region 731 where the cigar holder 701 is secured to a mounting fixture 715, it should be apparent that second mounting region 731 could be secured to a second mounting structure or a second point on the mounting fixture 715. The holding region 721 is the interconnection between the first mounting region 711 and the second mounting region 731. Located in the holding region 721 is the vessel shaped holder 741 with a rim 743, a continuous outer side 745, and a bottom 747. Bottom 747 in the preferred embodiment is perforated in order for ash, debris, and dirt to pass through the vessel shaped holder 741 without vessel shaped holder 741 or cup accumulating said ash, debris, and dirt. While a cigar 725 is illustrated as being retained by the vessel shaped holder 741 it should be apparent that other items likely to be contained in the users pockets may be contained by the vessel shaped holder including but not limited to drinks, cups, keys, phones, notepads, pens, pencils, golf balls, lighters, scissors, tees. In an alternative embodiment, the second mounting region 731 could be used to secure a cigar instead of a second attachment point for the cigar holder 601. Also, the second mounting region 731 could be of sufficient length to enable the user to secure a second cigar and connect the cigar holder 601 to the second point of attachment while retaining a first cigar in the vessel shaped holder 741. Additionally, the vessel shaped holder 741 could be created out of the flexible rod such that the entire holder 701 is made from a single piece of flexible rod.

In this embodiment the first mounting region 711 and the second mounting region 731 have an additional layer 755 applied. Layer 755 provides additional griping to the cigar holder 701. Layer 755 is preferably a tactile rubber compound; however layer 755 could be made of vinyl, silicone, PVC, leather or other materials that increase the friction between the cigar holder 701 and the mounting fixture 715.

It is apparent that an assembly with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A holder for securing cigars to a mounting structure, comprising:

a flexible rod having a first end, a second end opposite a first end, and a middle region located between the first end and the second end, the first end having an adjustable helical shape for securing the holder to the mounting structure, and the second end having an adjustable helical shape for retaining a cigar relative to the holder; and a perforated tab coupled adjacent to the second end;

wherein the middle region is configured for supporting the retained cigar.

2. The holder according to claim 1, further comprising:

a first cap covering the first end and a second cap covering the second end of the flexible rod.

3. The holder according to claim 1, further comprising:

an anti-slip coating covering at least a portion of the flexible rod for increasing friction between the holder and the mounting structure.

4. The holder according to claim 1, further comprising:

a vessel shaped holder, attached to the flexible rod, and located between the first end and the second end.

5. The holder according to claim 4, wherein the vessel shaped holder is perforated.

* * * * *